US008893815B2

(12) United States Patent
Mauney

(10) Patent No.: US 8,893,815 B2
(45) Date of Patent: Nov. 25, 2014

(54) FIRE EXTINGUISHER AND DISCHARGE NOZZLE ASSEMBLY

(75) Inventor: Ronald C. Mauney, Snow Camp, NC (US)

(73) Assignee: UTC Fire & Security Corporation, Farmington, CT (US)

( * ) Notice: Subject to any disclaimer, the term of this patent is extended or adjusted under 35 U.S.C. 154(b) by 830 days.

(21) Appl. No.: 13/128,282

(22) PCT Filed: Dec. 23, 2008

(86) PCT No.: PCT/US2008/088132

§ 371 (c)(1),
(2), (4) Date: May 9, 2011

(87) PCT Pub. No.: WO2010/074684

PCT Pub. Date: Jul. 1, 2010

(65) Prior Publication Data

US 2011/0214885 A1 Sep. 8, 2011

(51) Int. Cl.

| | |
|---|---|
| ***A62C 31/05*** | (2006.01) |
| ***A62C 31/02*** | (2006.01) |
| ***A62C 13/64*** | (2006.01) |
| ***A62C 13/62*** | (2006.01) |
| ***B05B 1/14*** | (2006.01) |
| ***B05B 1/34*** | (2006.01) |
| ***A62C 13/76*** | (2006.01) |

(52) U.S. Cl.

CPC ..... *A62C 13/76* (2013.01); *A62C 31/05* (2013.01)

USPC ..... 169/74; 169/30; 169/46; 239/463; 239/552

(58) Field of Classification Search

CPC ..... A62C 11/00; A62C 13/00; A62C 13/003; A62C 13/62; A62C 13/64; A62C 13/76; A62C 31/05; B05B 1/14; B05B 1/3415

USPC ..... 169/30, 46, 71, 74, 76, 89; 239/11, 337, 239/375, 463, 468, 469, 548, 552, 553, 589, 239/596, 597, 601

See application file for complete search history.

(56) References Cited

U.S. PATENT DOCUMENTS 1,967,894 A * 7/1934 Mapes ..... 169/30
2,651,547 A * 9/1953 Calhoun ..... 239/490

(Continued)

FOREIGN PATENT DOCUMENTS

WO 2008033220 3/2008

OTHER PUBLICATIONS

International Preliminary Report on Patentability, date of completion Jan. 19, 2011 (4 pgs.).

(Continued)

*Primary Examiner* — Darren W Gorman
(74) *Attorney, Agent, or Firm* — Cantor Colburn LLP

(57) ABSTRACT

A fire extinguisher, a discharge nozzle assembly for discharging a fluid under pressure, and a method for discharging a wet chemical fire extinguishing agent are presented. The discharge nozzle assembly includes a nozzle housing and a nozzle body inserted in the nozzle housing and defining a plurality of parallel flow passages. In an embodiment, the nozzle body defines three flow passages that are positioned equidistant radially from the longitudinal axis of the discharge nozzle and that are arrayed in the pattern of an equilateral triangle.

13 Claims, 2 Drawing Sheets

(56) References Cited

U.S. PATENT DOCUMENTS

| | | | | | |
|---|---|---|---|---|---|
| 2,778,434 | A | * | 1/1957 | Hastert et al. | 169/89 |
| 3,139,934 | A | * | 7/1964 | Gorski | 169/74 |
| 3,425,939 | A | | 2/1969 | Juillard et al. | |
| 3,504,862 | A | * | 4/1970 | Lowry | 239/565 |
| 3,724,763 | A | * | 4/1973 | Braun | 239/490 |
| 4,034,813 | A | | 7/1977 | Le Day | |
| 4,154,304 | A | | 5/1979 | Steibing et al. | |
| 4,484,710 | A | * | 11/1984 | Roznieck i | 239/290 |
| 4,567,948 | A | * | 2/1986 | Roznieck i | 169/76 |
| 4,619,328 | A | | 10/1986 | Seyler et al. | |
| 4,815,541 | A | | 3/1989 | Arrington | |
| 4,862,968 | A | | 9/1989 | Woodman | |
| 5,127,582 | A | * | 7/1992 | Roberts | 239/553.3 |
| 5,445,226 | A | | 8/1995 | Scott et al. | |
| 5,775,432 | A | | 7/1998 | Burns et al. | |
| 5,878,964 | A | * | 3/1999 | Hansen | 239/556 |
| 6,527,058 | B1 | * | 3/2003 | Nerat | 169/30 |
| 6,742,599 | B1 | | 6/2004 | Nam | |
| 6,886,640 | B1 | | 5/2005 | Dushkin et al. | |
| 2004/0256118 | A1 | | 12/2004 | Dunster et al. | |
| 2006/0185859 | A1 | | 8/2006 | Lin | |
| 2008/0250939 | A1 | | 10/2008 | See et al. | |

OTHER PUBLICATIONS

International Search Report and Written Opinion mailed Feb. 19, 2009 (9 pgs.).

* cited by examiner

FIRE EXTINGUISHER AND DISCHARGE NOZZLE ASSEMBLY

FIELD OF THE INVENTION

This invention relates generally to the discharge of fluid under pressure and, more particularly, to a discharge nozzle assembly for discharging a fluid under pressure and a portable fire extinguisher for fighting kitchen fires that incorporates the discharge nozzle assembly.

BACKGROUND OF THE INVENTION

Kitchen fires in homes often involve cooking fats and oils aflame in an open skillet on a range. Historically, portable fire extinguishers for fighting kitchen fires have used a dry chemical class BC fire extinguishent such as sodium bicarbonate. The basic principle behind dry chemicals in extinguishing cooking fires is to combine the fatty esters in the cooking fat or oil with a metal alkali salt. While such dry chemical class BC fire extinguishents have been effective for fighting cooking fires involving animal fats, they exhibited a significantly reduced effectiveness when used in fighting fires involving lighter vegetable-based cooking oils.

As a result, a new class of fire hazard, termed class K, was identified in view of the unique characteristics associated with such cooking oil fires. In fighting a cooking oil fire with a wet chemical fire extinguishing agent, the delivery of the wet chemical agent must not be so forceful as to disturb the surface of the cooking oil, which could cause hot oil to be splashed out of the skillet and result in spreading of the fire to surrounding surfaces. Discharge nozzles associated with conventional fire extinguishers typically discharge a high impact stream of fire extinguishing fluid that can splash the burning cooking fat or oil unto surrounding surfaces, particularly when used by individuals not trained in fire fighting. Conventional discharge nozzles include a relatively large diameter outlet passageway, typically having an inner diameter of about 10 or 11 millimeters, through which the fire extinguishing fluid is discharged.

International patent application publication PCT/US2007/019009 discloses an aerosol fire extinguisher, stated to be rated for class A, B, C and K fires, wherein the fire extinguishing agent is discharged through an elongated slot-like orifice having a length of about 0.075 inches+/−0.01 inches and a width of about 0.035 inches+/−0.01 inches.

SUMMARY OF THE INVENTION

In an aspect of the invention, a fire extinguisher is provided having an improved discharge nozzle assembly for delivering a spray of wet chemical fire extinguishing agent in a low impact, focused spray uniformly over the sprayed surface. The fire extinguisher includes a vessel containing a wet chemical fire extinguishing agent, a discharge valve assembly capping the vessel, an actuator operatively associated with the discharge valve assembly, and a discharge nozzle assembly in fluid communication with said discharge valve assembly. The discharge nozzle includes a nozzle housing and a nozzle body defining three parallel flow passages for discharging the fire extinguishing agent upon actuation of the discharge valve assembly. The nozzle housing defines a central flow passage having a discharge end and an inlet end in flow communication with the discharge valve assembly. The nozzle body is disposed in the discharge end of the central passage and defines three flow passages extending through the nozzle body. The three flow passages extend longitudinally parallel to a longitudinal axis of the nozzle body and are positioned equidistant radially from the longitudinal axis and disposed at the respective corners of an equilateral triangle. Each of the flow passages may includes a discharge orifice formed in a discharge end of the flow passage. A flow agitator may be disposed within each of the three flow passages extending through the nozzle body. The wet chemical fire extinguishing agent contained within the fire extinguisher may be an aqueous solution of an alkali metal salt and water. In an embodiment, the wet chemical fire extinguishing agent may be an aqueous solution of potassium acetate and water. The aqueous solution of potassium acetate and water may include a corrosion inhibitor.

In an aspect of the invention, a discharge nozzle assembly is provided for discharging an aqueous solution of fire extinguishing agent as a low-impact, focused spray. The discharge nozzle assembly includes a nozzle housing and a nozzle body defining three parallel flow passages for discharging the fire extinguishing agent. The nozzle housing defines a central flow passage having a discharge end. The nozzle body is disposed in the discharge end of the central passage and defines three flow passages extending through the nozzle body. The three flow passages extend longitudinally parallel to a longitudinal axis of the nozzle body and are positioned equidistant radially from the longitudinal axis and disposed at the respective corners of an equilateral triangle. Each of the flow passages may includes a discharge orifice formed in a discharge end of the flow passage. A flow agitator may be disposed within each of the three flow passages extending through the nozzle body.

In an aspect of the invention, a method is provided for discharging an aqueous solution from a fire extinguisher comprising the step of discharging three parallel streams of the aqueous solution from the nozzle with the three parallel flow streams arranged to discharge at the respective points of an equilateral triangle. The method may include the further step of imparting a swirl to each flow stream of the three flow streams of aqueous solution prior to discharge.

In an aspect of the invention, a discharge nozzle assembly is provided for discharging a fluid from a source of fluid under pressure. The nozzle assembly includes a nozzle housing defining a central flow passage having a discharge end and an inlet end. The inlet end of the central passage is in fluid communication with the source of fluid under pressure. The nozzle body is disposed in the central passage of the nozzle housing and defines a plurality elongated flow passages extending longitudinally through the nozzle body. Each of the flow passages extends parallel to a longitudinal axis of the nozzle body. In an embodiment, the nozzle body defines three elongated flow passages extending longitudinally through the nozzle body parallel to the longitudinal axis of the nozzle body. In an embodiment, the three elongated flow passages may be positioned equidistant radially from the longitudinal axis and disposed at the respective corners of an equilateral triangle. A discharge orifice may be formed in a discharge end of each of the flow passages extending through the nozzle body. A flow agitator may be disposed within each of the flow passages extending through the nozzle body.

BRIEF DESCRIPTION OF THE DRAWINGS

For a further understanding of the invention, reference will be made to the following detailed description of the invention which is to be read in connection with the accompanying drawing, where.

DETAILED DESCRIPTION OF THE INVENTION

Figure 2:
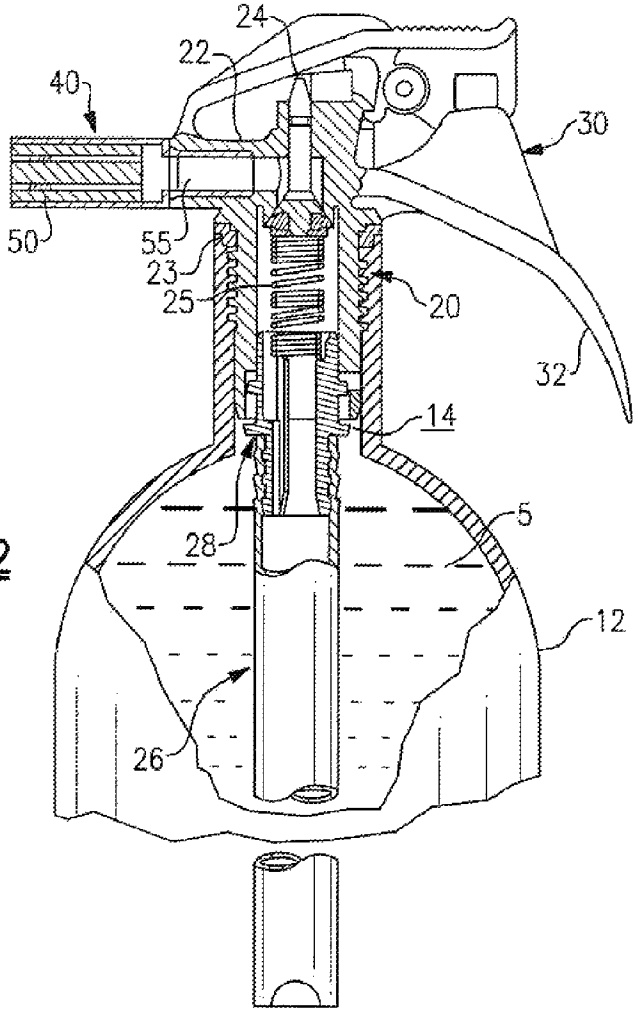
FIG. 2 a side elevation view, partly in section, of the upper portion of the portable fire extinguisher of FIG. 1 showing an exemplary embodiment of a discharge valve assembly.
Figure 1:
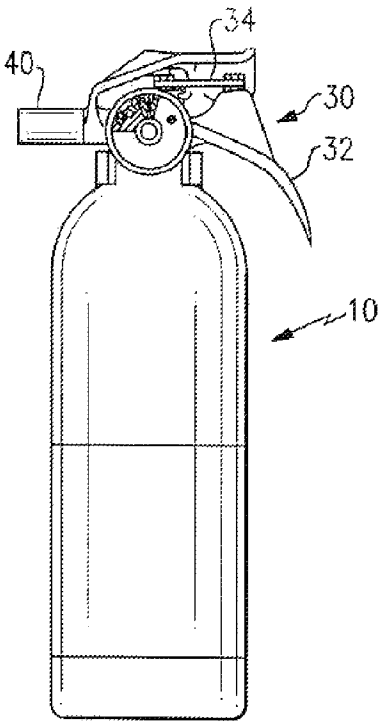
FIG. 1 is an elevation view of a portable fire extinguisher.

Referring initially to FIGS. 1 and 2 of the drawing, there are depicted exemplary embodiments of a fire extinguisher 10 including a vessel 12 containing a wet chemical fire extinguishing agent 5, a discharge valve assembly 20 capping the outlet throat 14 of the vessel 12, an actuator 30 operatively associated with the discharge valve assembly 20, and a discharge nozzle 40 in fluid communication with said discharge valve assembly 20. The fire extinguisher 10, as depicted, is a portable, hand-held fire extinguisher. The actuator 30 may be of the conventional squeeze handle type having a handle 32 that is held in its non-deployed position by a safety lock pin 34, although other types of manual actuators may also be employed.

In the depicted embodiment, the discharge valve assembly 20 may be of the conventional type, having a valve body 22, a valve stem 24, a return spring 25 and a valve-to-siphon tube coupling 28. It is to be understood, however, by those of ordinary skill in the art that other designs of the discharge valve assembly may readily be employed. The valve body 22 defines a flow cavity extending axially therein that opens at its inlet end in fluid communication with a siphon tube 26 that extends downwardly into a lower region of the vessel 12 and opens at its outlet end to the discharge nozzle 40. The valve body 22 is threaded into the neck of the vessel 12 and is received at its lower end into one end of the valve-to-siphon tube coupling 28. A seal ring 23 is disposed between the valve body 20 and the neck of the vessel 12 to ensure a sealing relationship therebetween. The siphon tube 26 is received into the other end of the valve-to-siphon tube coupling 28, whereby fluid flow communication is established between the flow cavity through the valve body 22 and the interior of the vessel 12. In the valve's non-actuated state, the valve stem 24 is biased upwardly by the return spring 25, which seats on the coupling 28, thereby closing off the outlet end of the flow cavity through the valve body 22 and preventing fluid flow into the discharge nozzle 40.

When it is necessary to use the fire extinguisher to suppress a fire, the user pulls the safety lock pin 34 out of the actuator 30 to release the handle 32 and then squeezes the handle to actuate the discharge valve assembly 20 by driving the valve stem 24 downwardly against the force of the return spring 25 thereby opening a flow path through the discharge valve assembly 20 whereby wet chemical fire extinguishing agent passes from the interior of the vessel 12 through the flow cavity of the valve body 22 into and through the discharge nozzle 40. When the operator releases the handle 32, the return spring 25 forces the valve stem 24 upwardly to again close the outlet from the flow cavity within the valve body 22.

To facilitate the use of the fire extinguisher 10 in suppressing kitchen fires, in particular class K fires, such as cooking oil fires, the wet chemical fire extinguishing agent contained within vessel 5 of the fire extinguisher 10 may comprise an aqueous solution of an alkali metal salt and water. In an embodiment, the wet chemical fire extinguishing agent may be an aqueous solution of potassium acetate and water, such as for example an aqueous solution of about 50% by weight of potassium acetate and about 50% by weight of water. The aqueous solution of potassium acetate and water may include a corrosion inhibitor. A suitable aqueous solution of potassium acetate and water that includes less than one percent of a corrosion inhibitor is commercially available from Cryotech Deicing Technology, Fort Madison, Iowa, USA, and is marketed under the tradename Cryotech E36.

Referring now to FIGS. 3-8, in particular, the discharge nozzle 40 includes a nozzle housing 50 and a nozzle spray insert 60 defining three parallel flow passages 65 for discharging the fire extinguishing agent upon actuation of the discharge valve assembly 20. The nozzle housing 50 defines a central flow passage 55 having an inlet end 52 in flow communication with the discharge valve assembly 20 and a discharge end 54. In an embodiment, the nozzle housing 50 may be made out of a polymeric plastic, such as an acetal plastic, for example a polyoxymethylene copolymer available from BASF marketed under the tradename Ultraform W2320.

The nozzle spray insert 60 is disposed in the discharge end 54 of the central passage 55 and defines the three flow passages 65 extending through the nozzle body 50. The three flow passages 65 extend longitudinally parallel to a longitudinal axis 61 of the nozzle spray insert 60 and are positioned equidistant radially from the longitudinal axis 61. Additionally, the three flow passages 65 are arrayed in the pattern of an equilateral triangle, each with its respective longitudinal central axis 67 passing through a respective one of the vertices of the equilateral triangle. In an embodiment, the nozzle spray insert 60 may also be made out of a polymeric plastic, such as an acetal plastic, for example a polyoxymethylene copolymer available from BASF marketed under the tradename Ultraform W2320.

Figure 3:
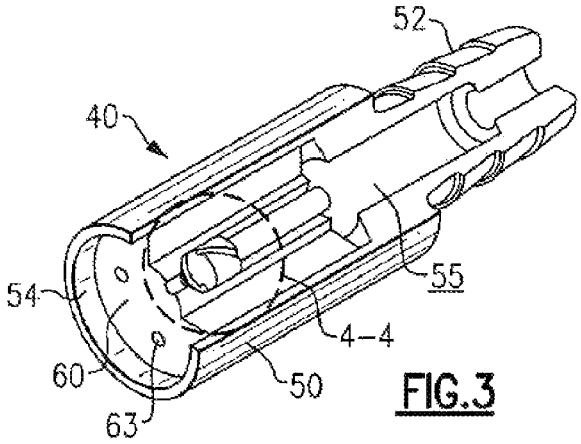
FIG. 3 is perspective view, partly in section, of an exemplary embodiment of a discharge nozzle in accordance with the invention.
Figure 4:
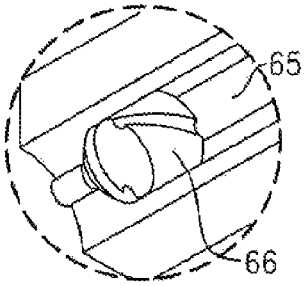
FIG. 4 is an enlarged, perspective view of the flow agitator taken along line 4 of FIG. 3.
Figure 6:
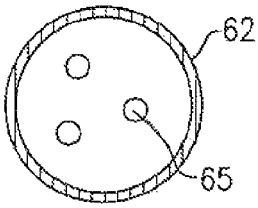
FIG. 6 is a cross-section view of the discharge nozzle of FIG. 5 taken along line 6-6.
Figure 5:
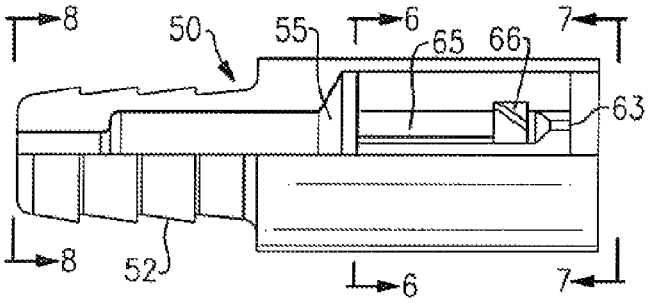
FIG. 5 is an elevation view of the discharge nozzle of FIG. 3.
Figure 7:
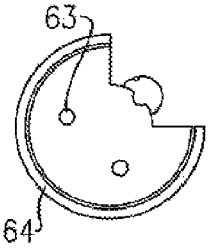
FIG. 7 is an end view of the discharge end of the discharge nozzle of FIG. 5 taken along line 7-7.
Figure 8:
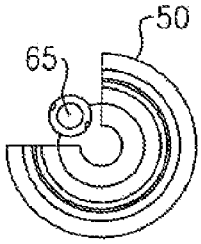
FIG. 8 is an end view of the inlet end of the discharge nozzle of FIG. 5 taken along line 8-8.

Each of the flow passages 65 has an inlet end 62 in flow communication with the central passage 55 through the nozzle body 50 and at discharge end 64 longitudinally distal from the inlet end 62. In an embodiment of the discharge nozzle 40, as best seen in FIGS. 3-5, each flow passage 65 may include a discharge orifice 63 formed at the discharge end 64 of the flow passage 65. In operation, the aqueous solution fire extinguishing agent passes from the vessel 5 upon actuation of the discharge valve assembly 20 to flow into the central passage 55 of the nozzle body 50 and thence into and through each of the flow passages 65 to discharge from the discharge nozzle 40 through the discharge orifices 63.

A flow agitator 66 may also be disposed within each of the three flow passages 65 extending through the nozzle body 50. In an embodiment, the flow agitators 66 may be formed of a nylon material, such as a nylon material commercially available from DuPont under the tradename ST-801HS BK010. Each flow agitator 66 imparts a swirl to the aqueous solution flowing through the flow passage 65 in which the agitator is disposed before the flow enters the discharge orifice 63 at the discharge end 64 of the flow passage.

For purposes of illustration, but not limitation, by way of example, an exemplary discharge nozzle 40 might have a nozzle body 60 having a length of 19.1 millimeters, an external diameter of 14.3 millimeters, three flow passages 65 each having an internal diameter of 3.2 millimeters and spaced laterally apart about 5.5 millimeters center-to-center, in the pattern of an equilateral triangle, and each having a discharge orifice 63 having a diameter of 1.1 millimeters.

In the method of discharging an aqueous solution of fire extinguishing agent as disclosed herein, as the aqueous solution is discharged from each of the discharge orifices 63 at the respective discharge ends 64 of the flow passages 65, which as noted previously are disposed relative to each other at the vertices of an equilateral triangle, the aqueous solutions expands forming a stream of mist droplets of the aqueous solution expanding outwardly from its longitudinal axis thereby developing a desired spray pattern. As the three independent streams of mist droplets expand outwardly from their respective longitudinal axis, the streams interfere with each other as they intersect in the region downstream of the nozzle. By imparting a swirl to each of the flow streams of aqueous solution discharging from the respective discharge orifices 63, the expansion outwardly of each flow stream will be enhanced and the resultant interference caused by the impingement upon one another of the three streams of mist droplets of the aqueous solution discharging from the discharge nozzle 40 is enhanced.

This intended interference characteristic of the multiple discharge nozzle assembly 40 and the discharge method disclosed herein produces a focused spray pattern that provides a volume of finely divided droplets of liquid fire extinguishing agent, while maintaining the low impact force generally associated with a much slower and more widely dispersed spray pattern such as produced by conventional spray nozzles. The intended interference between the multiple streams discharging from the plurality of discharge passages of the discharge nozzle assembly 40 deflects the discharging streams into a more focused mist spray which enhances fire extinguishing effectiveness and reduces the physical impact of the focused streams upon the surface of the burning cooking oil, thereby substantially reducing disruption of the surface of the cooking oil and the potential spreading the burning cooking oil unto any surrounding surfaces.

Although the discharge nozzle assembly 40 has been described hereinbefore in application on a fire extinguisher charged with a wet chemical fire extinguishing agent particularly suited for use in extinguishing class K fires, it is to be understood that the discharge nozzle 40 disclosed herein produces a mist spray of liquid droplets and may also be used in connection with any fire extinguisher dispensing a wet chemical fire extinguishing agent whether particularly suitable for suppressing any one or more of class A fires, class B fires, class C fires and class K fires. Further, the discharge nozzle assembly 40 may be used in various other non-fire extinguishing applications for discharging a fluid from a source of fluid under pressure.

The terminology used herein is for the purpose of description, not limitation. Specific structural and functional details disclosed herein are not to be interpreted as limiting, but merely as basis for teaching one skilled in the art to employ the present invention. While the present invention has been particularly shown and described with reference to the exemplary embodiments as illustrated in the drawing, it will be recognized by those skilled in the art that various modifications may be made without departing from the spirit and scope of the invention. Those skilled in the art will also recognize the equivalents that may be substituted for elements described with reference to the exemplary embodiments disclosed herein without departing from the scope of the present invention.

Therefore, it is intended that the present disclosure not be limited to the particular embodiment(s) disclosed as, but that the disclosure will include all embodiments falling within the scope of the appended claims.

I claim:

1. A fire extinguisher comprising:

vessel containing a wet chemical fire extinguishing agent;

a discharge valve assembly capping said vessel;

an actuator operatively associated with said discharge valve assembly; and a discharge nozzle in fluid communication with said discharge valve assembly, said discharge nozzle including:

a nozzle housing defining a central flow passage having a discharge end and an inlet end, the inlet end in flow communication with said discharge valve assembly;

a nozzle body disposed in the discharge end of the central passage, said nozzle body defining a plurality elongated flow passages extending longitudinally through said nozzle body, said flow passages extending parallel to a longitudinal axis of said nozzle body, a discharge orifice being formed in a discharge end of each of said flow passages, and a flow agitator being disposed adjacent said discharge orifice within each of said flow passages extending through said nozzle body.

2. A fire extinguisher as recited in claim 1 wherein the discharge orifice is arranged downstream with respect to the flow agitator.

3. A fire extinguisher as recited in claim 1 wherein said nozzle body defines three elongated flow passages extending longitudinally through said nozzle body parallel to the longitudinal axis of said nozzle body.

4. A fire extinguisher as recited in claim 3 wherein said three elongated flow passages are positioned equidistant radially from the longitudinal axis and disposed at the respective corners of an equilateral triangle.

5. A fire extinguisher as recited in claim 1 wherein the wet chemical fire extinguishing agent comprises an aqueous solution of an alkali metal salt and water.

6. A fire extinguisher as recited in claim 1 wherein the wet chemical fire extinguishing agent comprises an aqueous solution of potassium acetate and water.

7. A fire extinguisher as recited in claim 6 wherein the aqueous solution of potassium acetate and water includes a corrosion inhibitor.

8. A fire extinguisher as recited in claim 1 wherein the vessel containing a wet chemical fire extinguishing agent comprises a hand-held container.

9. A discharge nozzle assembly for discharging an aqueous solution of fire extinguishing agent from a hand-held fire extinguisher comprising:

a nozzle housing defining a central passage; and a nozzle body disposed in a discharge end of the central passage, said nozzle body defining three flow passages extending through said nozzle body, said three flow passages extending longitudinally parallel to a longitudinal axis of said nozzle body and being positioned equidistant radially from the longitudinal axis and disposed at the respective corners of an equilateral triangle, a discharge orifice being formed in a discharge end of each of said flow passages, and a flow agitator being disposed adjacent said discharge orifice within each of said flow passages extending through said nozzle body.

10. A method for discharging an aqueous solution from a portable fire extinguisher comprising the steps of:

discharging three parallel streams of the aqueous solution from a nozzle with the three parallel streams arranged to discharge at the respective points of an equilateral triangle; and imparting a swirl to each of the three parallel streams of aqueous solution prior to discharge, the swirl being imparted via a flow agitator arranged within a flow passage, adjacent a discharge orifice, of each of the three parallel streams.

11. A discharge nozzle assembly for discharging a fluid from a source of fluid under pressure, said nozzle assembly comprising:

a nozzle housing defining a central flow passage having a discharge end and an inlet end, the inlet end in fluid communication with the source of fluid under pressure; and a nozzle body disposed in the discharge end of the central passage of said nozzle housing, said nozzle body defining a plurality elongated flow passages extending longitudinally through said nozzle body, said flow passages extending parallel to a longitudinal axis of said nozzle body, a discharge orifice being formed in a discharge end of each of said flow passages, and a flow agitator being disposed adjacent said discharge orifice within each of said flow passages extending through said nozzle body.

12. A discharge nozzle assembly as recited in claim 11 wherein said nozzle body defines three elongated flow passages extending longitudinally through said nozzle body parallel to the longitudinal axis of said nozzle body.

13. A discharge nozzle assembly as recited in claim 12 wherein said three elongated flow passages are positioned equidistant radially from the longitudinal axis and disposed at the respective corners of an equilateral triangle.

* * * * *